US005651716A

United States Patent [19]

Mowrer et al.

[11] Patent Number: 5,651,716

[45] Date of Patent: Jul. 29, 1997

[54] SOUND MODULATING TOY FIGURE

[75] Inventors: Kevin B. Mowrer, Loveland; Nick H. Langdon, Cincinnati, both of Ohio

[73] Assignee: Hasbro, Inc., Pawtucket, R.I.

[21] Appl. No.: 599,209

[22] Filed: Feb. 9, 1996

[51] Int. Cl.[6] ..... A63H 3/28

[52] U.S. Cl. ..... 446/301; 446/297

[58] Field of Search ..... 446/301, 329, 446/297, 298, 339, 302–303; 84/95.2, 95.1, 94.2, 94.1, 600, 718

[56] References Cited

U.S. PATENT DOCUMENTS

| | | | |
|---|---|---|---|
| 1,490,185 | 4/1924 | Ross | 446/297 |
| 1,876,753 | 9/1932 | Reuge | 84/95.2 |
| 3,060,631 | 10/1962 | Collischan | 446/301 |
| 3,443,338 | 5/1969 | Collins | 446/301 |
| 4,820,232 | 4/1989 | Takahashi et al. | 446/298 |

*Primary Examiner*—Robert A. Hafer
*Assistant Examiner*—Justine Yu
*Attorney, Agent, or Firm*—Kurt R. Benson

[57] ABSTRACT

A sound producing toy figure consists of a head portion including resilient opposing jaw members movable between open and closed positions, a sound producing unit including a speaker for outputting audible sounds, a push-button switch for selectively actuating the sound producing unit to produce audible sounds, a lever-type manual actuator for moving the jaw members between their open and closed positions, and a muffler movable between a first position wherein the muffler is spaced apart from the speaker so that the sound can fully emanate from the speaker, and a second position wherein the muffler substantially covers the speaker so that the sounds cannot fully emanate from the speaker. The muffler is pivotably mounted externally on the body of the figure and it is mechanically coupled to the actuator lever such that as the muffler is manually moved towards and away from the speaker, the actuator lever is correspondingly actuated to open and close the jaw members. The resulting movement effect is to muffle the sound when the jaws are moved closed, and to allow full loud sound when the jaws are open thus simulating that the sounds are actually emanating from the figure's mouth. The actuator lever is further operable for actuating the sound switch when jaw members are first closed to initiate sound production.

11 Claims, 5 Drawing Sheets

SOUND MODULATING TOY FIGURE

BACKGROUND AND SUMMARY OF THE INVENTION

The instant invention relates generally to sound producing toy figures, and more particularly to a toy action figure having means for modulating the sound emanating from the figure.

Toy figures which have moving jaws and/or which produce sounds or voices have heretofore been known in the art. In this regard, the U.S. patents to Holahan et al U.S. Pat. No. 4,244,138, Amici et al U.S. Pat. No. 4,561,854, and Amici et al U.S. Pat. No. 4,622,020 are cited to show toy action figures with movable jaw members, while the U.S. patents to Cummings U.S. Pat. No. 4,799,171, Rissman et al U.S. Pat. No. 4,802,879, and Curran U.S. Pat. No. 4,923,428 are cited to show interactive talking dolls which produce audible speech in response to voice and other commands of the user.

Of particular interest to the instant invention are the U.S. patents to Green U.S. Pat. No. 3,570,178, Curran et al U.S. Pat. No. 4,775,352, Takahashi et al U.S. Pat. No. 4,820,232, Forse et al U.S. Pat. No. 4,949,327, and DeSmet U.S. Pat. No. 5,108,341 which are cited to show toy figures that produce voice sounds and which automatically move the mouth and other body parts of the figure in conjunction with the voice sounds to simulate that the figure is actually talking. Such toys are normally operated by means of a tape comprising audio track and a digital command track for automatically controlling movement of the toy figure while the audio portion is producing audible sounds. These types of toys are passive toys wherein the operator will sit and watch the figure as it appears to speak to them. While the cited toy figures have significant play value, there is nevertheless a continuing need, and consumer desire, for toy action figures in which sound production can be selectively actuated and controlled by the operator, and in which the operator takes a more active roll in playing with the figure.

The instant invention provides a sound producing toy figure comprising a body portion, a head portion including resilient opposing jaw members which are deformably movable between open and closed positions, a sound producing unit located in the body portion and including a speaker for outputting audible sounds, a push-button switch for selectively actuating the sound producing unit to produce recorded sound tracks, a manual actuator lever extending outwardly from the back of the body portion for manually moving the jaw members between their open and closed positions, and a muffler movable between a first position wherein the muffler is spaced apart from the speaker so that the sound can fully emanate from the speaker, and a second position wherein the muffler substantially covers the speaker so that the sounds cannot fully emanate from the speaker. The muffler is pivotably mounted externally on the body portion of the figure and it is mechanically coupled to the actuator lever such that as the muffler is manually moved towards and away from the speaker, the actuator lever is correspondingly actuated to open and close the jaw members. Accordingly, the sound emanating from the speaker is muffled when the jaws are moved closed, while on the other hand, the sound is allowed to fully emanate from the speaker when the jaws are open. The actuator lever includes an secondary appendage which is positioned for engagement with the switch assembly for initiating sound production when the actuator lever is first actuated to close the jaw members.

In use, the operator initially depresses the muffler body fully closed to initiate sound production, and thereafter reciprocates the muffler towards and away from the speaker thereby modulating the sound emanating from the speaker. As indicated above, modulation of the muffler also causes corresponding closing and opening movements of the jaws. The resulting effect is modulation or muffling of the sounds as the jaws are actuated closed and open, thus simulating that the sounds are actually emanating from the figure's mouth.

Accordingly, among the objects of the instant invention are: the provision of a toy figure having a head portion with movable jaw members; the provision of a toy figure which produces sound as the jaw members are moved to simulate that the sounds are emanating from the figure's mouth; the provision of a toy figure which modulates sound as the figure's mouth is opened and closed; and the provision of a sound modulating toy figure having a sound producing unit including a speaker, a muffler which is selectively receivable over the speaker by means of manual actuation, and an actuator lever coupled to the muffler to cause corresponding movement of the jaw members as the muffler is moved towards and away from the speaker.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
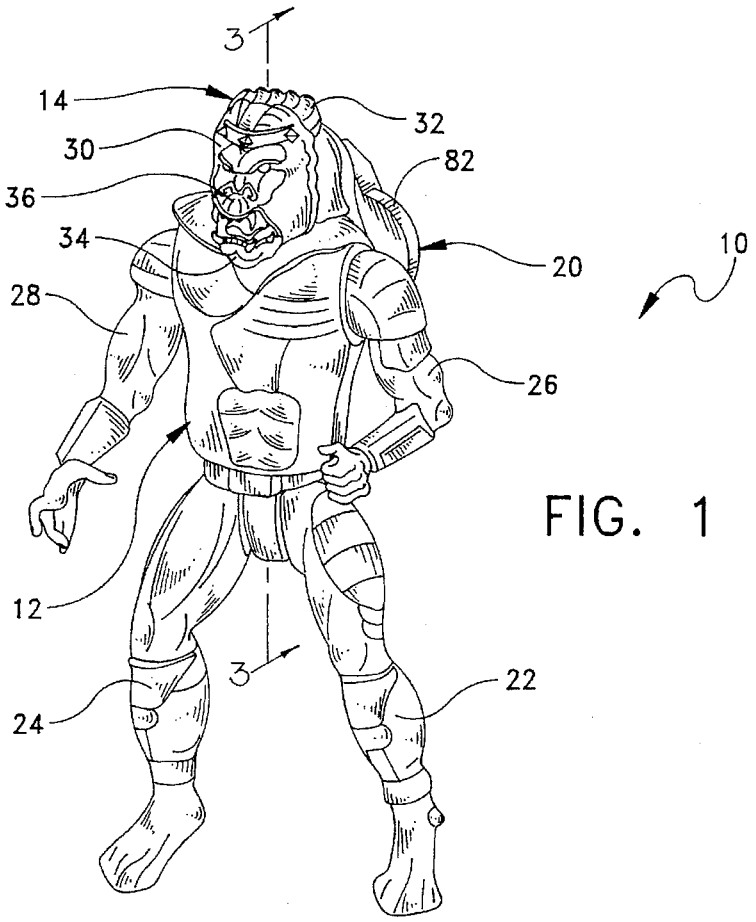
FIG. 1 is a perspective view of sound modulating toy figure of the instant invention.
Figure 2:
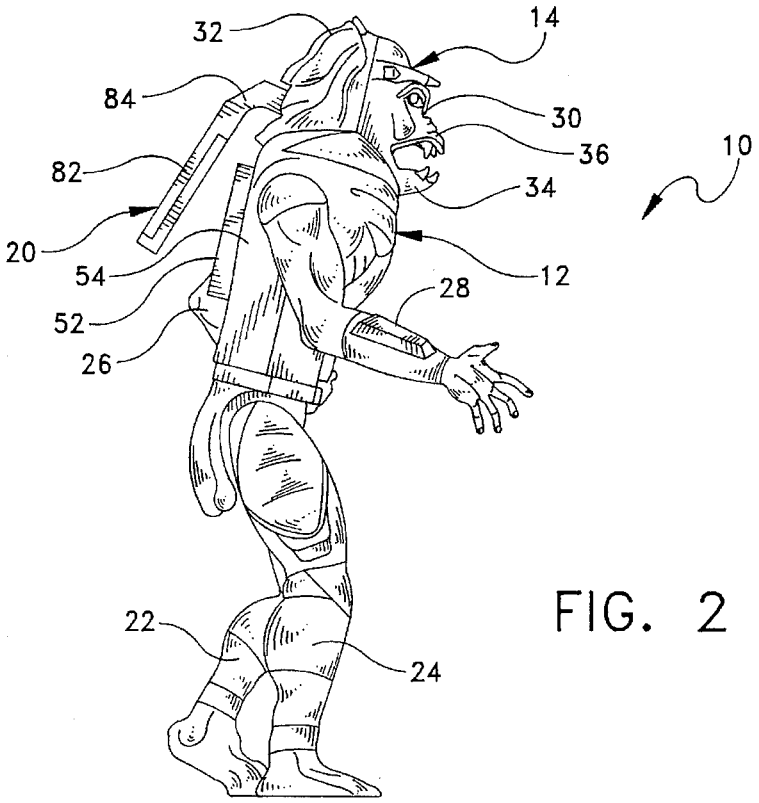
FIG. 2 is a side view thereof.

Referring now to the drawings, the sound modulating toy figure of the instant invention is illustrated and generally indicated at 10 in FIGS. 1–5. As will hereinafter be more fully described, the instant toy FIG. 10 is configured in the shape of a toy action figure having a fanciful human form. However, it is to be understood that the toy figure could also be embodied as any type of toy action figure, including animal figures.

The instant toy FIG. 10 comprises a body portion generally indicated at 12, a head portion generally indicated at 14, a sound producing unit generally indicated at 16 located in the body portion 12, a manual actuator lever generally indicated at 18, and a muffler element generally indicated at 20.

The body portion 12 is molded from a rigid and durable plastic material and includes a variety of ornamental surface details to simulate clothing and armor for the toy figure. The body portion 12 further includes left and right leg members 22, 24 respectively pivotably mounted to the lower end of the body portion 12, and left and right arm members 26, 28 respectively pivotably mounted to the upper end of the body portion 12. Construction of the body portion 12 and attachment of the limbs 22, 24, 26, 28 are well known skills in the toy arts and therefore the details of these aspects will not be further described herein.

Figure 3:
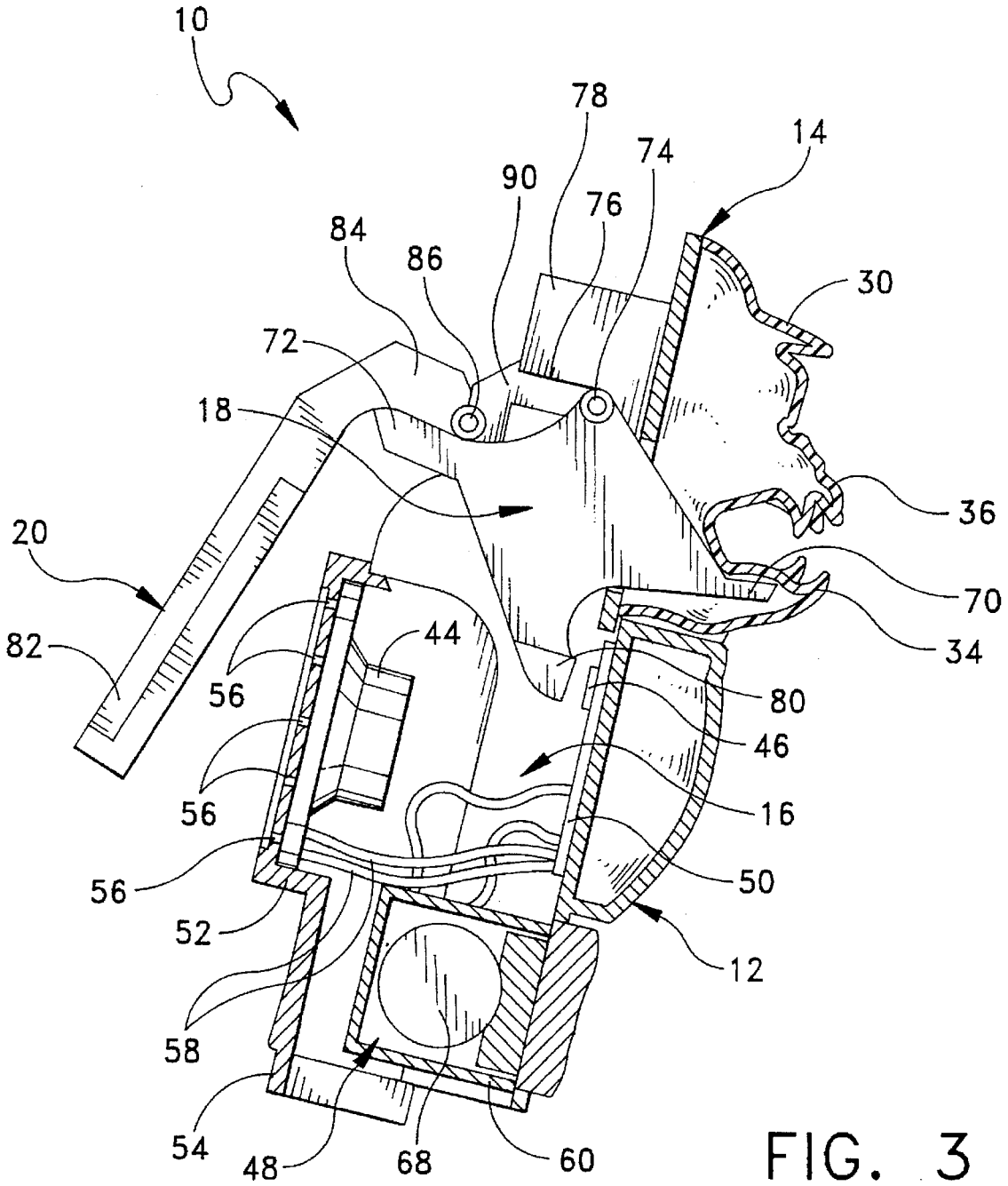
FIG. 3 is an enlarged cross-sectional view of the head and body portions thereof taken along line 3—3 of FIG. 1.
Figure 4:
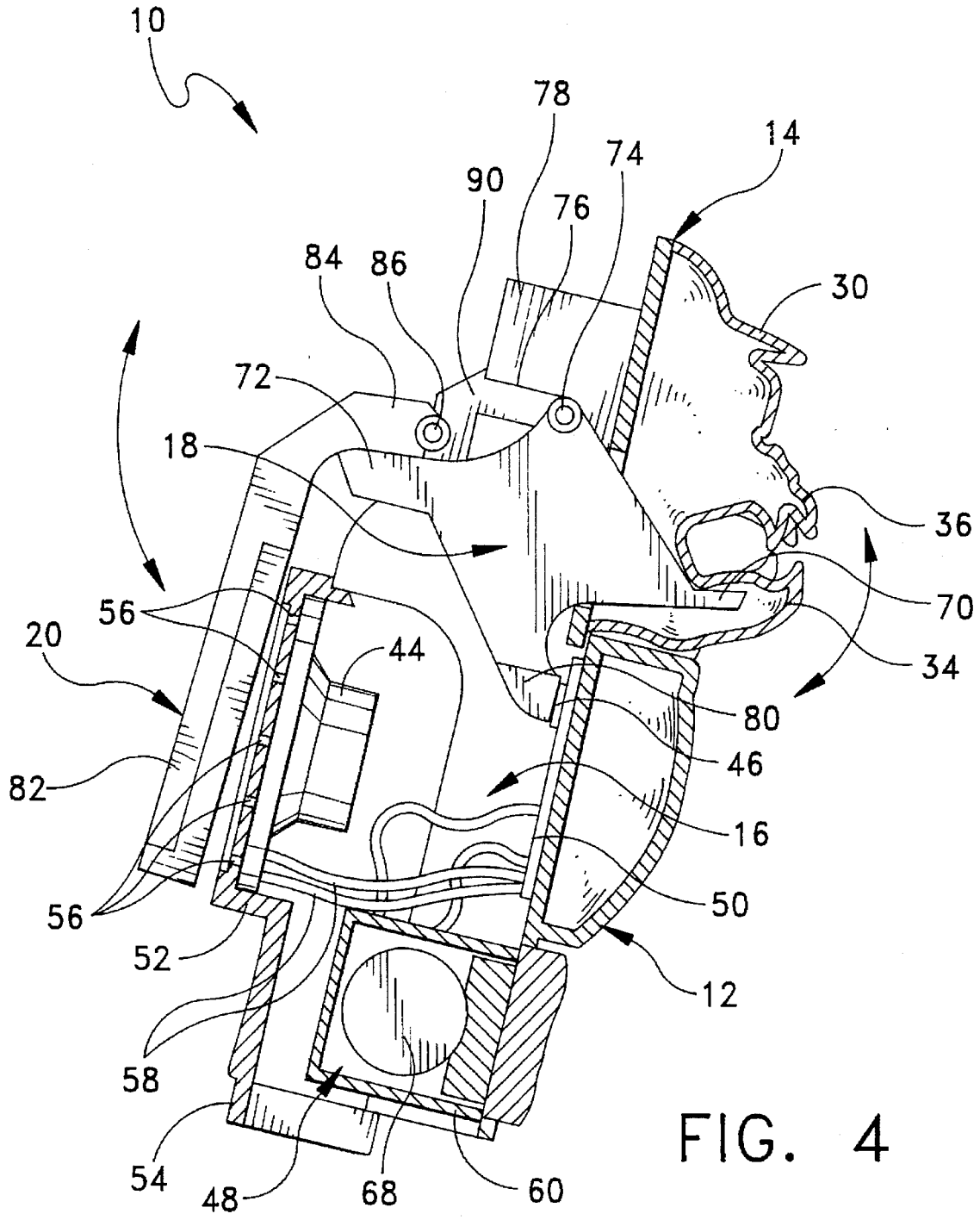
FIG. 4 is a similar view showing movement of the actuator lever and movable lower jaw.
Figure 5:
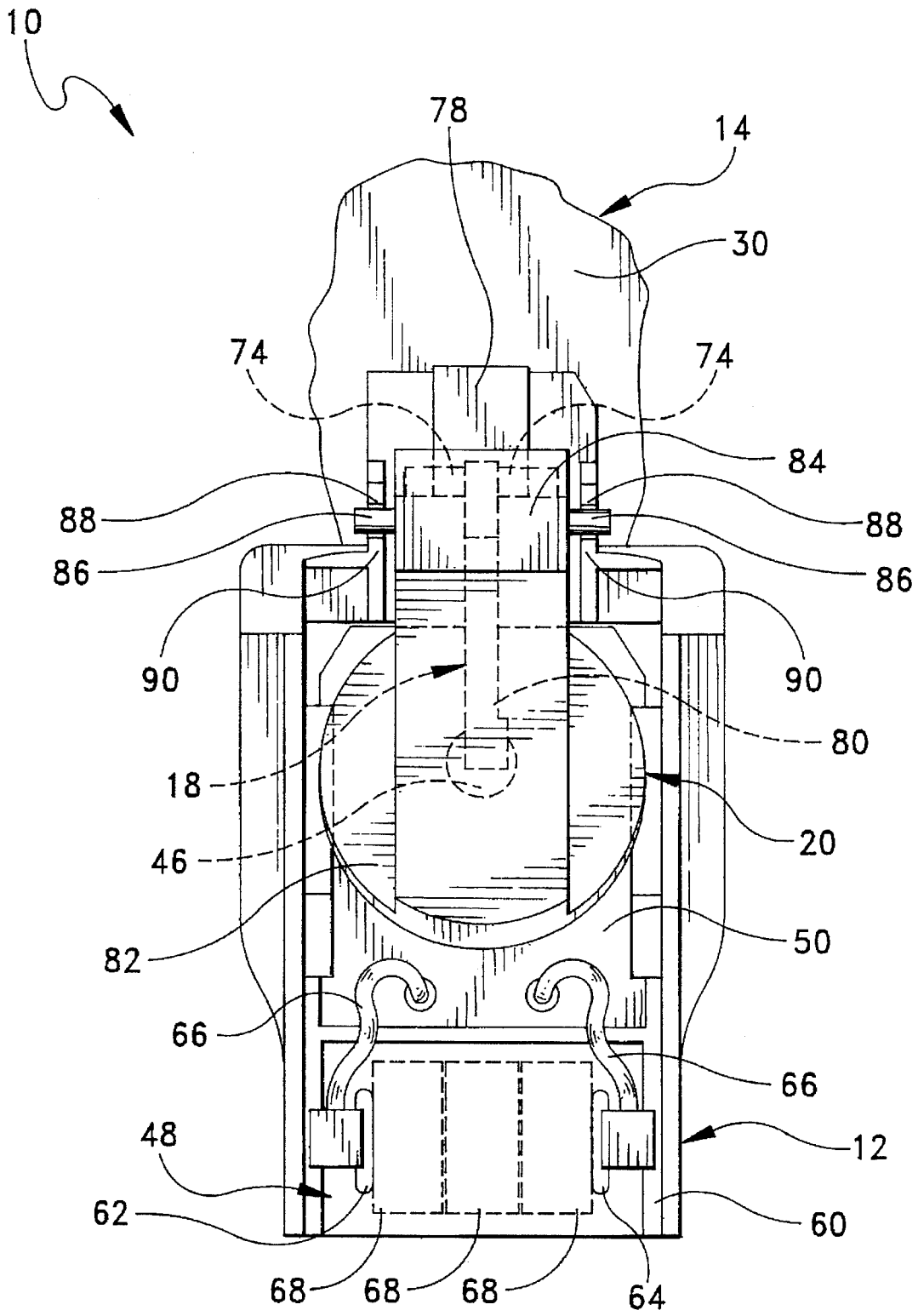
FIG. 5 is a rear elevation view of the head and body portions with the rear sections of the head and body portions removed for purposes of illustration.
Figure 6:
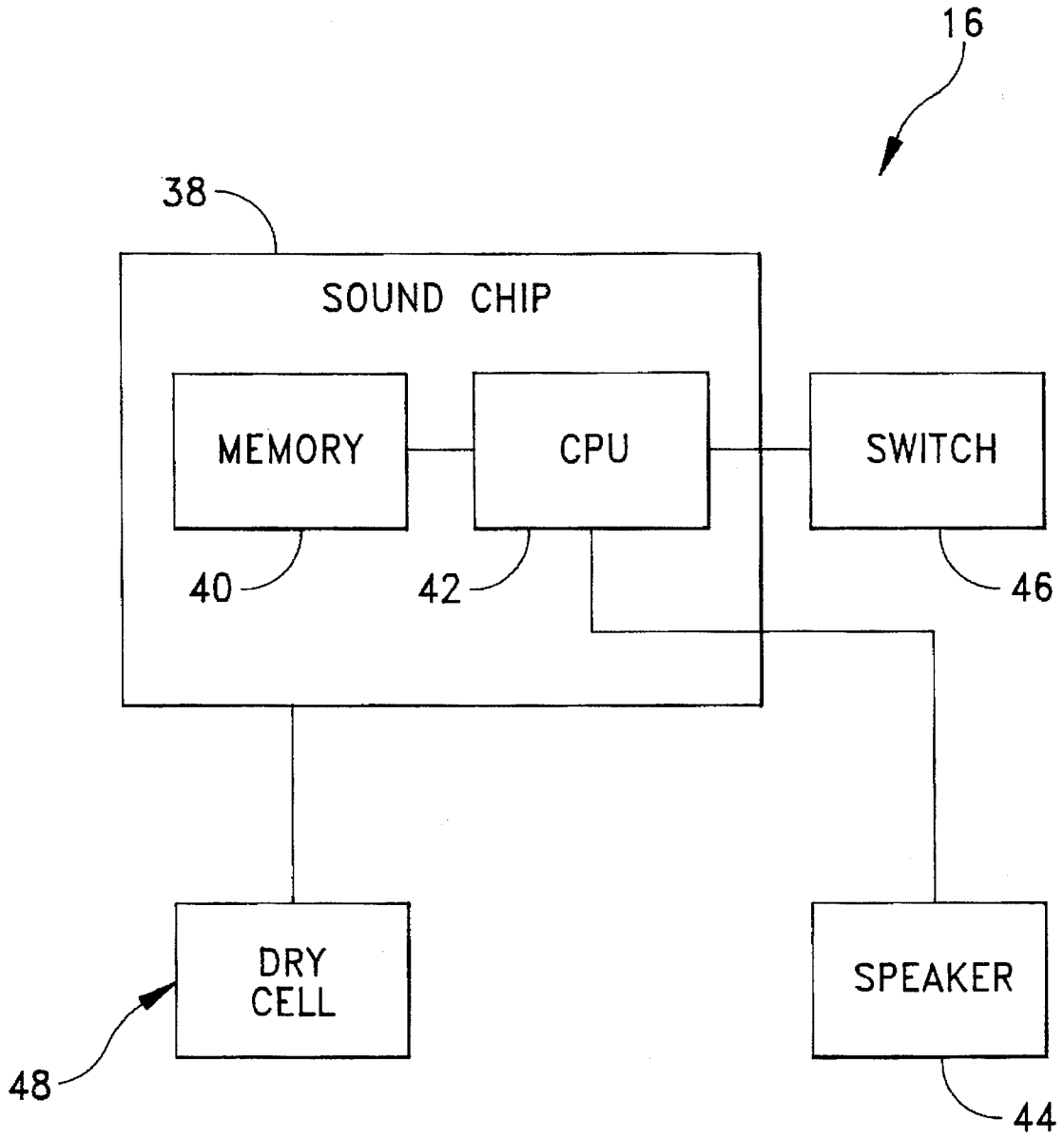
FIG. 6 is a schematic view of the sound unit.

The head portion 14 comprises front and rear section halves 30, 32 respectively which are received and secured in interfitting relation with the body portion 12. The rear section 32 is molded from a rigid plastic to provide structural stability while the front section 30 is formed from a resilient rubber or thermoplastic material. In this regard, the front section 30 is molded with fanciful facial features including resilient opposing first (lower) and second (upper) jaw members 34, 36 respectively which are deformably movable between an open position (FIG. 3), and a closed position (FIG. 4).

Referring to FIGS. 3–6, the sound producing unit 16 comprises a digital sound chip generally indicated at 38 (FIG. 6) including a memory 40 for digitally storing a predetermined sound and a central processing unit 42 for controlling operation of the chip 38. The sound producing unit 16 further comprises a speaker 44 for outputting audible sounds, a switch assembly 46 for selectively actuating the sound producing unit 16 to produce audible sounds, and a dry cell power source generally indicated at 48 for providing electrical power to the sound chip 38, and speaker 44. In the instant embodiment, a growling sound is recorded into the memory 40 of the digital sound chip 38 for selective output through the speaker 44. It is noted that digital sound chips 38 are commercially available through a variety of sources, and can record any type of sound to accommodate the particular type of toy figure in which the sound unit is incorporated. For example, if the toy figure comprised a dog, the sound chip could be provided with a barking sound. The digital sound chip 38 is mounted on a circuit board 50 which is mounted adjacent the front wall of the body portion 12. The speaker 44 is mounted in a recess 52 formed on the back wall 54 of the body portion 12. The recess portion 52 includes a plurality of openings 56 (FIGS. 3–4) adjacent the cone of the speaker 44 for allowing audible sound to emanate from the speaker 44 to the exterior of the body portion 12. The speaker is wired by wires 58 to corresponding contacts on the circuit board 50 in a conventional manner. The switch assembly 46 is supported on the circuit board 50, and is wired to the digital sound chip 38 according to a conventional wiring scheme. The switch assembly 46 comprises a push-button type switch which is normally maintained in an open configuration. Closure of the switch 46 closes the sound circuit, and causes the sound chip 38 to send amplified digital sound signals to the speaker 44 to produce the recorded sounds. The dry cell power source 48 comprises a housing 60 including positive and negative contacts 62, 64 which are wired to the circuit board 50 by wires 66 to provide electrical energy to the sound chip 38 and speaker 44, and further comprises a plurality of dry cell batteries 68 received in the housing 60 in electrical communication with the electrical contacts 62, 64. The specific electronic and wiring connections of the sound producing unit 16 are well known in the electronics arts, and therefore these aspects will not be described in further detail.

The actuator lever 18 comprises an action end 70 which is disposed within the lower deformable jaw 34, and an actuator end 72 which extends outwardly from the back of the body portion 12. In this regard, the actuator lever 18 is pivotably mounted at a pivot point wherein downward movement of the actuator end 72 causes upward movement of the action end 70, and corresponding upward movement of the lower jaw 34 from the open position (FIG. 3) to the closed position (FIG. 4). More specifically, the central portion of actuator lever 18 includes two outwardly extending pins 74 which are received in a slot 76 formed in frame member 78 disposed within the head portion 14 of the FIG. 10. The pins 74 serve as a fulcrum to create the jaw closure action as previously described hereinabove. The lever 18 further includes a secondary appendage 80 which is normally disposed in spaced relation to the switch assembly 46 on the circuit board 50 (See FIG. 3). The appendage 80 is operable for engaging and actuating the switch 46 when the actuator end 72 of lever 18 is moved as described hereinabove (See FIG. 4). Accordingly, it can be seen that when the actuator lever 18 is moved downwardly, the jaw members 34, 36 are closed, and the sound producing unit 16 is actuated to produce the recorded sounds.

The muffler element 20 comprises a circular body portion 82 which is receivable over the openings 56 in the back of the body portion 12, and an arm portion 84 which is pivotably secured within the rear section 32 of the head portion 14. More specifically, the arm portion 84 of the muffler 20 includes two outwardly extending pins 86 which are respectively received in slots 88 formed within spaced walls 90 which extend upwardly from the body portion 12 of the FIG. 10 into the rear section 32 of the head portion 14. The rear section 32 of the head portion 14 is received over the pivot arrangements to secure the arm portion 84 of the muffler 20, and the actuator lever 18 in position. The muffler 20 is pivotably movable between a first position wherein the body portion 82 of the muffler 20 is spaced apart from the body portion 12 of the FIG. 10 (FIG. 3) so that the sound can fully emanate from the speaker 44, and a second position wherein the body portion 84 of the muffler 20 substantially covers the speaker openings 56 (FIG. 4) so that the sounds cannot fully emanate from the speaker 44. Referring to FIG. 3, the arm portion 84 of the muffler 20 is normally engaged with the actuator end 72 of the actuator lever 18 such that the muffler 20 is normally maintained in the first position, i.e. spaced away from the body portion 12. During use, as the muffler 20 is manually moved towards and away from the speaker 44, the actuator lever 18 is correspondingly actuated to open and close the jaw members 34, 36. Accordingly, the sound emanating from the speaker 44 is muffled when the jaws 34, 36 are moved closed, while on the other hand, the sound is allowed to fully emanate from the speaker 44 when the jaws 34, 36 are open.

In use, the operator initially depresses the muffler body 82 fully closed to cause the actuator lever 18 to actuate the switch 46 and initiate sound production, and thereafter reciprocates the muffler body 82 towards and away from the speaker openings 56 thereby modulating the sound emanating from the speaker 44. As indicated above, modulation of the muffler 20 also causes corresponding closing and opening movements of the jaws 34, 36. The resulting effect is modulation or muffling of the sounds as the jaws 34, 36 are actuated closed and open, thus simulating that the sounds are actually emanating from the figure's mouth.

It can therefore be seen that the instant invention provides a unique and novel toy FIG. 10 which is believed to have significant play value. The instant invention provides a toy FIG. 10 having a head portion 14 with manually actuable movable jaw members 34, 36 which requires active play involvement of the operator. The instant invention provides a toy FIG. 10 which produces sound as the jaw members 34, 36 are moved to simulate that the sounds are emanating from the figure's mouth. The instant invention further provides a toy FIG. 10 which modulates sound as the figure's mouth is opened and closed, and still further provides a sound modulating toy FIG. 10 having a sound producing unit 16 including a speaker 44, a muffler 20 which is selectively receivable over the speaker 44 by means of manual actuation, and an actuator lever 18 coupled to the muffler 20 to cause corresponding movement of the jaw members 34, 36 as the muffler 20 is moved towards and away from the speaker 44. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. A sound producing toy figure comprising:

a head portion including a pair of opposing jaw members movable between a first position wherein said jaw members are in spaced relation, and a second position wherein said jaw members are in adjacent relation;

a sound producing unit including a speaker for outputting audible sounds;

switch means for selectively actuating said sound producing unit to produce said audible sounds;

actuator means for actuating said pair of first and second jaw members between the first and second positions thereof; and a muffler movable between a first position wherein said muffler is spaced apart from said speaker so that said audible sounds can fully emanate from said speaker, and a second position wherein said muffler substantially covers said speaker so that said audible sounds cannot fully emanate from said speaker, said muffler being coupled to said actuator means such that said muffler is moved from the first position thereof to the second position thereof when said pair of jaw members is moved from the first position thereof to the second position thereof, and further such that said muffler is moved back to the first position thereof when said pair of jaw members is moved back to the first position thereof.

2. The sound producing toy figure of claim 1 wherein said actuator means is further operable for actuating said switch means when said pair of jaw members is actuated.

3. The sound producing toy figure of claim 1 wherein said actuator means is operable for actuating said switch means when said pair of jaw members is moved from said first position thereof to said second position thereof.

4. A sound producing toy figure comprising:

a body portion;

a head portion including a pair of first and second opposing jaw members movable between a first position wherein said jaw members are in spaced relation, and a second position wherein said jaw members are in adjacent relation;

means for normally biasing said pair of jaw members to said first position;

a sound producing unit located in said body portion, said sound producing unit including a speaker for outputting audible sounds, said speaker being located adjacent a back wall of said body portion, said back wall including openings therein adjacent said speaker for allowing said audible sound to emanate from within said body portion;

switch means for selectively actuating said sound producing unit to produce said audible sounds;

actuator means for actuating said pair of first and second jaw members from said first position thereof to said second position thereof, said means for normally biasing said pair of jaw members automatically returning said pair of jaw members to said first position thereof; and a muffler pivotably mounted to said toy figure adjacent said openings in said back wall for movement between a first position wherein said muffler is spaced apart from said back wall so that said audible sounds can fully emanate from said speaker, and a second position wherein said muffler substantially covers said openings in said back wall so that said audible sounds cannot fully emanate from said speaker, said muffler being coupled to said actuator means such that when said muffler is moved from said first position thereof to said second position thereof said pair of jaw members is moved from said first position thereof to said second position thereof, said muffler being automatically moved back to said first position thereof when said pair of jaw members is normally biased back to said first position thereof.

5. The sound producing toy figure of claim 4 wherein said actuator means is operable for actuating said switch means when said pair of jaw members is moved from said first position thereof to said second position thereof.

6. A sound producing toy figure comprising:

a body portion;

a head portion including a pair of upper and lower resilient, deformable jaw members movable between a first position wherein said jaw members are in spaced relation, and a second position wherein said jaw members are in adjacent relation, said resilient jaw members being normally biased to said first position;

a sound producing unit located in said body portion, said sound producing unit including a speaker for outputting audible sounds, said speaker being positioned adjacent a back wall of said body portion, said back wall including openings for allowing said audible sounds to escape from said body portion;

switch means for selectively actuating said sound producing unit to produce said audible sounds;

actuator means for actuating said pair of upper and lower jaw members between said first and second positions thereof; and a muffler pivotably mounted to said toy figure adjacent said openings in said back wall for movement between a first position wherein said muffler is spaced apart from said speaker so that said audible sounds can fully emanate from said speaker, and a second position wherein said muffler substantially covers said speaker so that said audible sounds cannot fully emanate from said speaker, said muffler being coupled to said actuator means such that when said muffler is moved to said first position thereof said pair of jaw members is moved to said first position thereof, and further such that when said muffler is moved to said second position thereof said pair of jaw members is moved to said second position thereof.

7. The sound producing toy figure of claim 6 wherein said actuator means is operable for actuating said switch means when said pair of jaw members is moved from said first position thereof to said second position thereof.

8. The sound producing toy figure of claim 6 wherein said actuator means comprises a pivoting lever arm having an action end disposed within said deformable lower jaw and an actuator end extending outwardly from said body portion, said lever arm being pivotally movable wherein movement of said actuator end causes upward movement of said action end and corresponding movement in said lower jaw for moving said pair of jaw members from said first position thereof to said second position thereof.

9. The sound producing toy figure of claim 8 wherein said lever arm further includes a secondary appendage normally disposed in spaced relation to said switch means, said appendage being operable for engaging and actuating said switch means when said actuator end of said lever arm is moved.

10. The sound producing toy figure of claim 9 wherein said actuator end of said lever arm engages with a portion of said muffler such that pivotal movement of said muffler from said first position thereof to said second position thereof causes corresponding downward movement of said actuator end of said lever arm thereby causing movement of said pair of jaw members, and actuation of said switch means.

11. A sound producing toy figure comprising a body including a head having a pair of jaw portions which cooperate to define a mouth, said jaw portions being moveable for moving said mouth between open and closed positions thereof;

a sound producing unit in said body, said sound producing unit including a speaker and being actuable for producing sounds through said speaker;

a muffler for muffling sounds produced from said speaker, said muffler being moveable between muffling and non-muffling positions relative to said speaker;

means for moving said jaw portions to move said mouth between the open and closed positions thereof and for simultaneously moving said muffler between the muffling and non-muffling positions thereof.

* * * * *